US006549173B1

(12) United States Patent
King et al.

(10) Patent No.: US 6,549,173 B1
(45) **Date of Patent: *Apr. 15, 2003**

(54) ANTENNA FEED AND A REFLECTOR ANTENNA SYSTEM AND A LOW NOISE (LNB) RECEIVER, BOTH WITH SUCH AN ANTENNA FEED

(75) Inventors: Gerard King, Reading (GB); Jamie Stokes, Reading (GB)

(73) Assignee: Channel Master Limited (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/701,604

(22) PCT Filed: May 28, 1999

(86) PCT No.: PCT/GB99/01712

§ 371 (c)(1),
(2), (4) Date: Jan. 23, 2001

(87) PCT Pub. No.: WO99/63624

PCT Pub. Date: Dec. 9, 1999

(30) Foreign Application Priority Data

Jun. 2, 1998 (GB) ..... 9811850

(51) Int. Cl.[7] ..... H01Q 13/00
(52) U.S. Cl. ..... 343/772; 343/786
(58) Field of Search ..... 343/753, 762, 343/771, 772, 781 R, 786

(56) References Cited

U.S. PATENT DOCUMENTS 3,430,249 A * 2/1969 Franfs ..... 343/911
5,552,797 A * 9/1996 Cook ..... 343/786
6,020,859 A * 2/2000 Kildal ..... 343/781 P

FOREIGN PATENT DOCUMENTS

GB WO 90/13927 * 11/1990 ..... H01Q/19/08

* cited by examiner

*Primary Examiner*—Don Wong
*Assistant Examiner*—Shih-Chao Chen
(74) *Attorney, Agent, or Firm*—Gifford, Krass, Groh, Sprinkle, Anderson & Citkowski, P.C.

(57) ABSTRACT

The present invention relates to antenna feeds (10, 30, 70, 78, 94) for use in linear or circularly polarized systems. In one embodiment of the invention, a cross-type antenna feed (30) comprises a cylindrical metal waveguide housing (12) and a cross-type metal feed body (32) coupled to the front of the waveguide housing (12). The feed body (32) has four peripherally spaced corrugated arm portions (34) arranged in a mutually orthogonal relationship, where the arm portions (34) extend radially outwardly from a longitudinal axis (16) of the feed body (32). Ridges (36) on each arm portion (34) are arranged concentrically around the axis (16) and parallel thereto, with successive ridges spaced from the axis (16) in a tiered arrangement. In another embodiment the antenna feed is a dielectric lens. The antenna feed is used in an antenna system having a reflector antenna in addition or in a low noise block (LNB) receiver.

13 Claims, 8 Drawing Sheets

ANTENNA FEED AND A REFLECTOR ANTENNA SYSTEM AND A LOW NOISE (LNB) RECEIVER, BOTH WITH SUCH AN ANTENNA FEED

FIELD OF THE INVENTION

The present invention relates to antenna feeds for use in linear or circularly polarised systems. Particularly, but not exclusively, the invention relates to dual polarity antenna feeds particularly suitable for use in linearly polarised systems operating at S-band frequencies (approximately in the range 2 to 3 GHz) and Ku-band frequencies (about 12 GHz).

BACKGROUND OF THE INVENTION

Conventionally, horn antenna feeds are used as dual polarity offset parabolic antenna feeds for systems operating at S-band frequencies; however, dielectric lens antenna feeds (sometimes called polyrod lenses) may be used instead of horn antenna feeds because horn antenna feeds for use at S-band frequencies are relatively large. FIG. 1 shows a typical prior art dielectric lens antenna and FIG. 2 shows the corresponding symmetrical radiation beam pattern with a 10 dB half beamwidth of 42.5°. FIG. 3 shows a typical prior art corrugated horn antenna feed and FIG. 4 shows the corresponding symmetrical radiation pattern. The corrugated feed shown in FIG. 4 has a 35° 10 dB half beamwidth. The horn feed shown in FIG. 3 shows complete round corrugations with a constant feed angle θ which results in the beam pattern of FIG. 4.

Dielectric lens antenna feeds have the advantage that they are physically smaller than horn antenna feeds but provide similar electrical performance.

The dielectric lens is made of solid plastic material typically by a plastic moulding process but-this gives rise to manufacturing problems because the outside of the moulded lens cools quicker than the inside and premature removal from the mould before the plastics material has fully set can result in physical discontinuities in the lens, such as cavities, which reduce performance of the lens in the antenna feed. Merely waiting a much longer time for the plastics material to set reduces manufacturing throughput and increases the cost per unit item. This problem is exaggerated for lower frequency lenses which are physically larger in size.

It is an object of the present invention to provide an antenna feed which obviates or mitigates at least one of the above disadvantages.

SUMMARY OF THE INVENTION

According to a first aspect of the present invention there is provided an antenna feed for use in a system for receiving orthogonal linear or circularly polarised signals, the antenna feed comprising an antenna feed body for coupling to a waveguide housing, the feed body defining a central axis and having spaced arms extending radially outwardly from the central axis for receiving the polarised signals.

By virtue of the present invention an antenna feed of reduced weight can be manufactured. The manufacturing process is less expensive than for conventional dielectric lens feeds because less dielectric material is required. In addition, because there is less volume of material, the lens cools quicker in the centre thereby minimising discontinuities and providing improved lens quality. The throughput of manufactured lenses can be increased because of the reduced cooling time requirements.

Where the antenna feed is a dielectric lens, the feed body advantageously has a generally cruciform cross-section and comprises a central dielectric core co-axial with the central axis, and peripherally-spaced dielectric arms of the cross disposed around the core. The arms may be separated from each other by an air gap or the arms may be separated from each other by, for example, another dielectric material. It will be appreciated that the central core and the arms are preferably manufactured as a single unit, by moulding or machining, thus there is no join between the arms and the central core. Alternatively, the central core may be made of separate pieces which are subsequently joined together.

Where the antenna feed is a cross-type feed, the spaced arms may be in the form of corrugated radially extending portions, each portion having ridges extending therefrom in spaced parallel relation.

It will be appreciated that the feed body and the housing for the lens or for the cross-type feed may be moulded or cast as an integral unit. This may lead to a reduction in weight and cost. The antenna feed may be adjusted to receive polarised signals of different beamshapes by changing a feed angle of the antenna feed, by adjusting a) the height of corrugations, b) the spacing between the corrugations and c) the position of the corrugations along the z-axis.

As will be appreciated by persons skilled in the art, references herein and in the following description to a feed angle of a cross-type antenna feed are to an angle defined between the central axis of the waveguide housing and a plane defining a surface connecting the ridge of each arm of the cross.

According to a second aspect of the present invention, there is provided an antenna feed for use in a system for receiving orthogonal linearly or circularly polarised signals, the antenna feed comprising an antenna feed body for coupling to a waveguide housing, the feed body defining a central axis and having a plurality of spaced arm portions extending radially outwardly from the central axis on a respective radius for receiving the polarised signals, each arm portion being corrugated and having at least one element arranged transversely to its respective radius.

Preferably, the antenna feed is a cross-type feed.

Preferably, the element comprises a substantially straight ridge. The element may be disposed substantially perpendicularly to the respective arm portion radius.

Conveniently, each arm portion has two or more elements arranged in spaced parallel relation.

Alternatively, the at least one element may comprise two or more straight ridges, disposed adjacent to and at an angle from one another. Preferably, each element comprises three straight ridges. Conveniently, each arm portion has two or more elements arranged in spaced parallel relation.

Preferably, the antenna feed body is generally cylindrical. The antenna feed body may be tubular.

Conveniently, the corrugated arm portions extend radially outwardly from the antenna feed body. There may be four corrugated arm portions disposed around a circumference of the antenna feed body. The corrugated arm portions may be mutually perpendicularly disposed around the circumference of the antenna feed body. Preferably, first and second mutually opposed ones of said corrugated arm portions are disposed at a first feed angle, whilst third and fourth mutually opposed ones of said corrugated arm portions are disposed at a second feed angle. It will be appreciated by persons skilled in the art that the disposition of the corrugated arm portions at first and second feed angles allows the antenna feed to generate an elliptical beam shape and to receive polarised signals from an elliptical dish.

According to a third aspect of the present invention there is provided a method of receiving orthogonal linear or circularly polarised signals, the method including the steps of:

providing an antenna feed body defining a central axis and having spaced arms extending radially outwardly from the central axis for receiving the polarised signals;

coupling the antenna feed body to a waveguide housing;

arranging the antenna feed body in relation to an antenna so that, in use, the arms of the antenna feed body receive polarised signals reflected by the antenna and convey these signals to the waveguide housing.

According to a fourth aspect of present invention there is provided an antenna system comprising:

a reflector antenna;

an antenna feed in accordance with the first aspect of the present invention; and a waveguide housing for coupling to the antenna feed, so that, in use signals are reflected by the antenna, received by the antenna feed, and propagated along the waveguide housing.

It will be appreciated that the feed body may have any convenient shape for example, the feed body may be generally circular, oval, square, or rectangular.

According to a fifth aspect of the present invention there is provided a low noise block (LNB) receiver for use with an antenna system, the LNB receiver comprising:

an antenna feed in accordance with the first aspect of the present invention;

a waveguide housing coupled to the antenna feed, the waveguide housing having probes disposed therein; and a circuit board in electrical communication with the probes having an output for providing electrical signals corresponding to incoming polarised signals.

BRIEF DESCRIPTION OF THE DRAWINGS

These and other aspects of the present invention will be apparent from the following description, given by way of example, with reference to the accompanying drawings, in which.

DETAILED DESCRIPTION OF THE PREFERRED EMBODIMENTS

Figure 5:
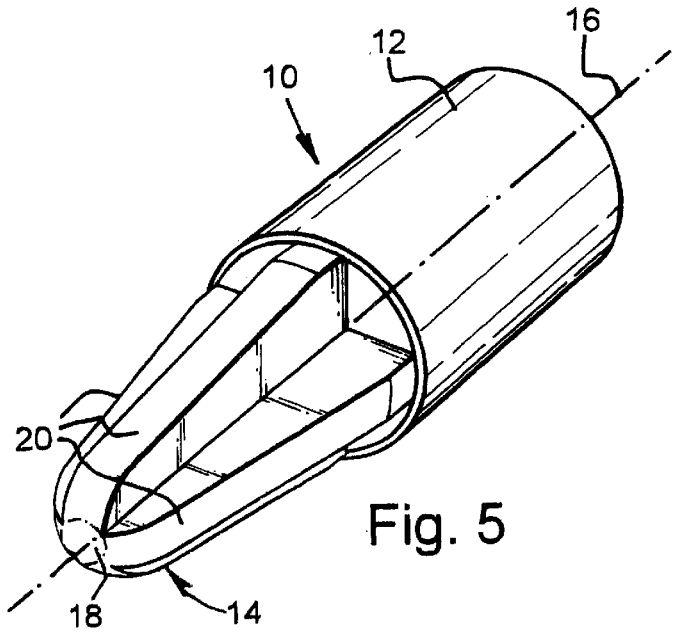
FIG. 5 is a pictorial view of a dielectric lens antenna feed in accordance with one embodiment of the present invention.

Reference is made first to FIGS. 5, 5*a*, 5*b* and 6 of the drawings. FIG. 5 shows a dielectric antenna feed 10 in accordance with one embodiment of the present invention for use at S-band frequencies of approximately 2.5 GHz. The feed 10 is a dielectric lens antenna feed comprising a waveguide housing 12 in the form of a cylindrical metal tube; and a dielectric feed body 14, made or polypropylene, coupled to and partially disposed within the front of the housing 12. The feed 10 defines a central (longitudinal) axis (shown by broken line 16) along which radiation is propagated.

Figure 5A:
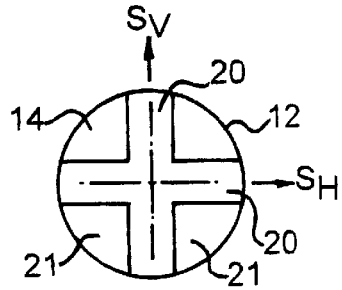
FIG. 5*a* is a diagram illustrating the alignment of a portion of the antenna feed of FIG. 5 with orthogonal components of a signal, where the polarisation is horizontal.
Figure 5B:
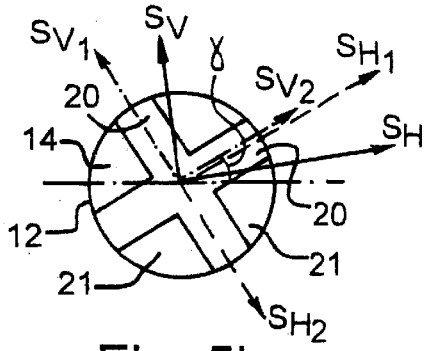
FIG. 5*b* is a diagram illustrating the alignment of a portion of the antenna feed of FIG. 5 with orthogonal components of a signal, where the polarisation is offset from the horizontal.

The feed body 14 has the general shape of a notched cone having a generally cruciform cross-section, as shown in FIGS. 5*a*, 5*b*; (transverse to the longitudinal axis 16). The length of the body 14 is approximately 140 mm and the diameter of the body 14 at the widest portion (which is the portion adjacent to the housing 12) is approximately 85 mm. The body 14 has a central dielectric (polypropylene) core 18 co-axial with the longitudinal axis 16. Four peripherally-spaced dielectric arms 20 (in the form of polypropylene fingers) are disposed around the central core 18 and extend radially outwardly from the central axis 16. The core 18 and fingers 20 are moulded as an integral unit. As shown in FIGS. 5*a*, 5*b* the spaces between adjacent fingers 20 define notches or air gaps 21 which result in the feed body 14 having a notched appearance. This ensures that there is a maximum amount of material left where the electric field is at a maximum.

Figure 11:
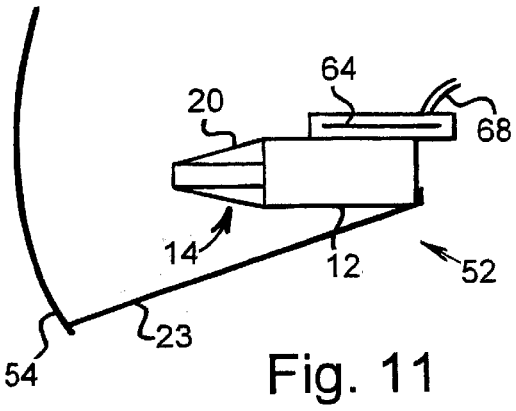
FIG. 11 is a schematic diagram of an antenna system in accordance with another embodiment of the present invention.

In use, the feed 10 is coupled to an antenna by a bracket 23 (FIG. 11) to illuminate a reflector antenna (FIG. 11). Although the feed body 14 is arranged and configured in relation to the antenna so that the fingers 20 are aligned with the orthogonal linearly polarised signals conveyed from the antenna, as shown diagrammatically in FIGS. 5*a,b* and 7*a,b,* there is, in fact, no need for the cross-shape to be aligned with the polarisation because any polarisation can be resolved into two orthogonal components aligned with the cross-shape. If alignment is performed, this is done by rotating the feed body 14 and the waveguide housing 12 so that the angular position of the fingers 20 changes with respect to the longitudinal axis 16.

In FIG. 5*a,* the orthogonal linearly polarised signals are shown by arrows labelled SV and SH; these signals are polarised perpendicular and parallel to the horizontal axis respectively. FIG. 5*b* shows the general case where the signals $S_V$, $S_X$ are polarised perpendicular and parallel to an angle (offset from the horizontal axis). The resolved components $S_{V1}$, $S_{V2}$, $S_{H1}$,$S_{H2}$ are shown aligned with the fingers 20 in broken outline. It is common to have signals polarised at an angle offset from the horizontal axis.

Figure 1:
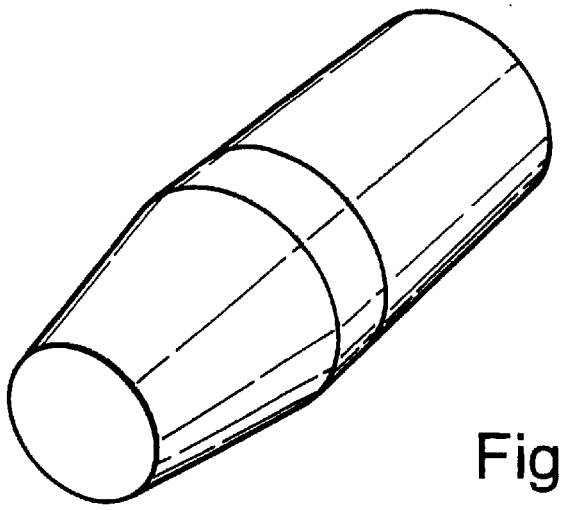
Fig. 1 PRIOR ART
FIG. 1 is a pictorial view of a prior art dielectric lens antenna feed.
Figure 2:
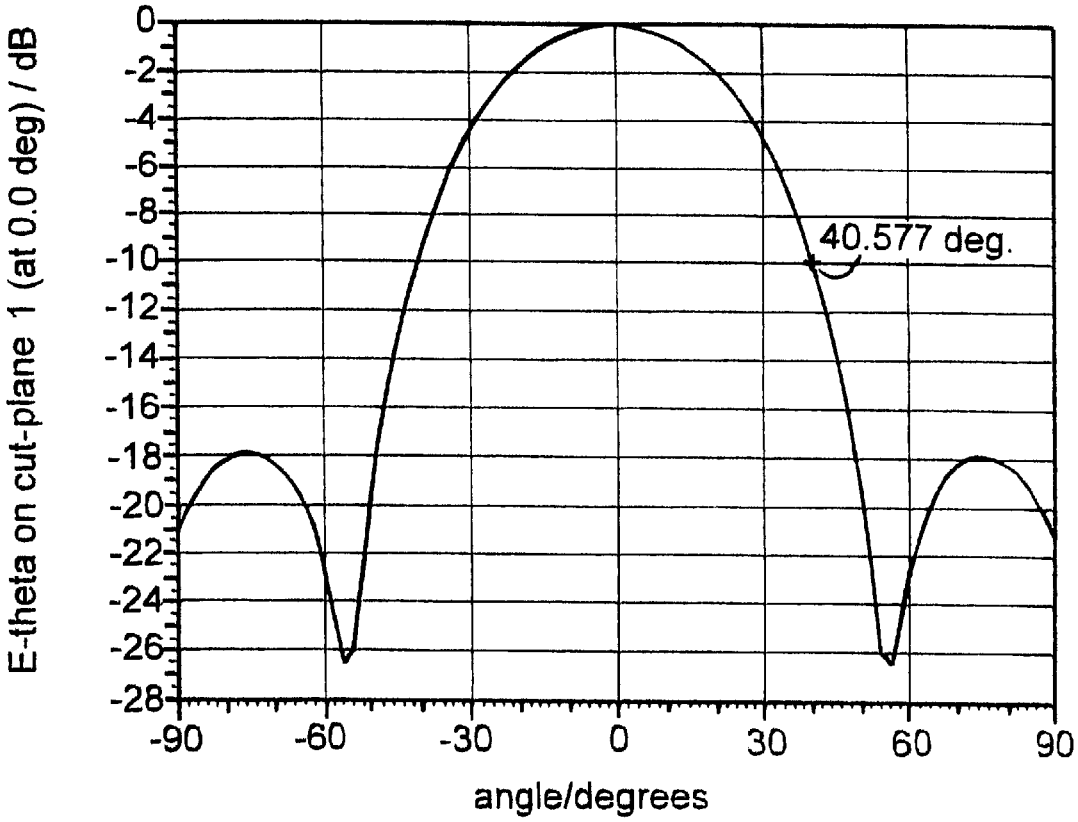
Fig. 2 PRIOR ART
FIG. 2 is a graph of the radiation pattern from the prior art lens of FIG. 1.
Figure 6:
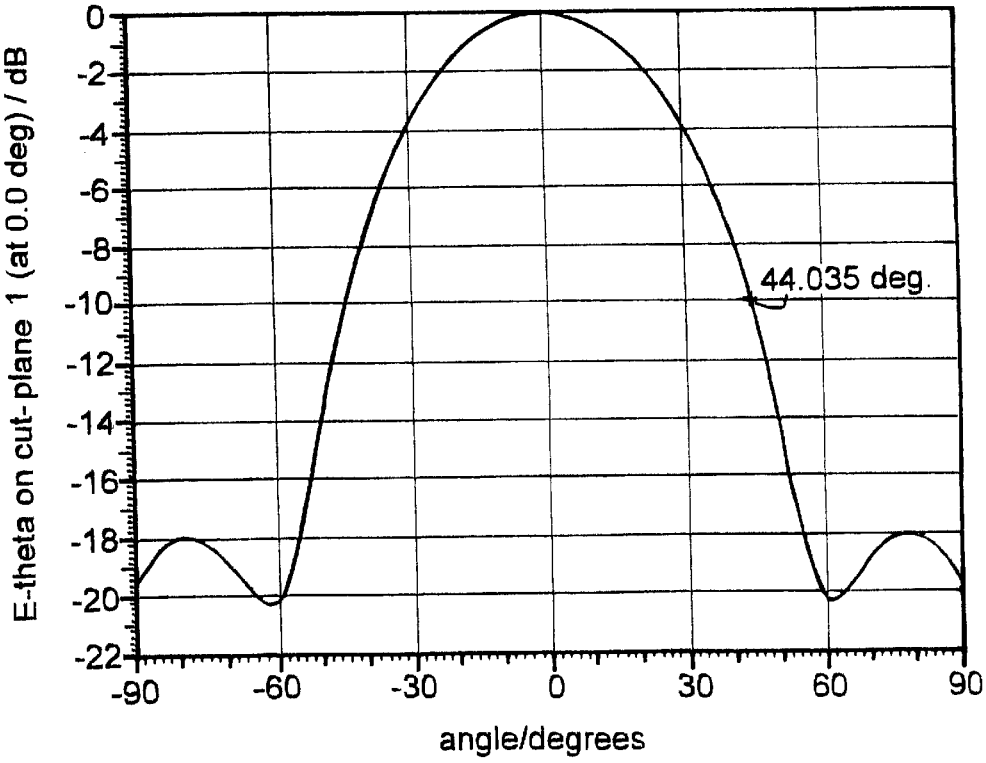
FIG. 6 is a graph of the radiation pattern from the antenna feed of FIG. 5.

FIG. 6 is a graph of the radiation pattern from the antenna feed of FIG. 5. It will be apparent that the symmetrical radiation beam pattern, 10 dB half beamwidth of 44°, from antenna feed 10 is very similar to the radiation pattern from the prior art antenna feed shown in FIG. 2. The shape of the two radiation patterns is very similar: the main difference between the two patterns is that the prior art feed has a 10 dB half beamwidth of 40.6°; whereas, feed 10 has a 10 dB half beamwidth of 44°.

Figure 7:
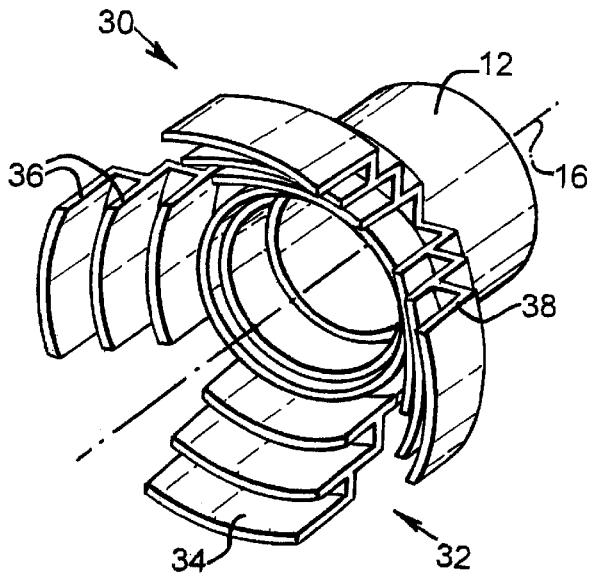
FIG. 7 is a pictorial view of a cross-type antenna feed in accordance with another embodiment of the present invention.
Figure 7A:
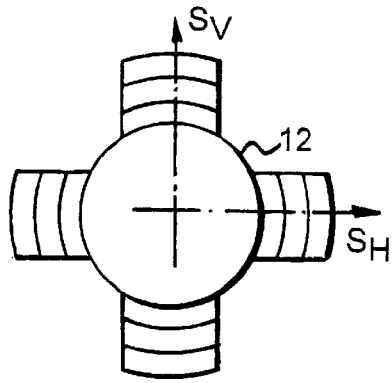
FIG. 7*a* is a diagram illustrating the alignment of a portion of the antenna feed of FIG. 7 with orthogonal components of a signal, where the polarisation is horizontal.
Figure 7B:
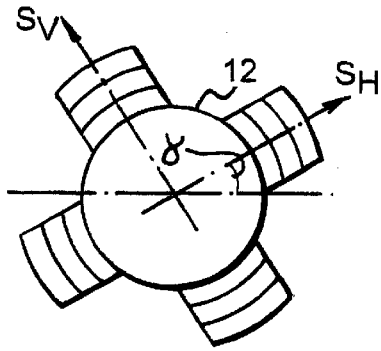
FIG. 7*b* is a diagram illustrating the alignment of a portion of the antenna feed of FIG. 7 with orthogonal components of a signal, where the polarisation is offset from the horizontal.

FIGS. 7, 7*a,* 7*b* and 8 show an antenna feed 30 in accordance with another embodiment of the present invention. The feed 30 is an antenna cross-type feed comprising a waveguide housing 12 (in the form or a cylindrical metal tube) and a cross-type feed body 32 couple to the front of waveguide housing 12. The body 32 is also made of metal and has four peripherally-spaced corrugated arm portions 34 in mutually orthogonal relationship. The arm portions 34 extend radially outwardly from the longitudinal axis 16 defined by the feed body 32.

The corrugations in the arm portions 34 are formed by ridges 36 extending away from waveguide housing 12 and parallel to the longitudinal axis 16. The ridges 36 on each arm portion 34 are spaced apart by steps 38 transverse to the longitudinal axis 16. The steps 38 link adjacent ridges 36. Thus, respective ridges 36 on each arm portion 34 are arranged concentrically around the longitudinal axis 16 and in parallel relation, with the ridge 36 closest to the waveguide housing 12 being closest to longitudinal axis 16 and successive ridges 36 being successively further from longitudinal axis 16 to give the ridges 36 a tiered appearance. When viewed from the front, as best seen in FIGS. 7*a,*7*b,* and along longitudinal axis 16, the feed 30 appears like a cross having a hollow centre. The beamshape can be adjusted by changing the feed angle by adjusting a) the height of the corrugations, b) the spacing between the corrugations and c) the position of the corrugations along the z-axis.

In the same way as for the FIG. 5 embodiment, in use, the feed 30 is located in an antenna system (FIG. 11) to illuminate a reflector antenna (FIG. 11) and the feed body 32 is arranged in relation to the antenna so that orthogonal linearly polarised signals are conveyed from the antenna. Although the arm portions 34 can be aligned as with the dielectric lens shown in FIG. 5*a,* there is also no requirement for the cross-shape to be aligned with the incoming polarisation for the same reason: any direction of polarisation can be resolved into two orthogonal components aligned in the cross-type arm portions 34. If alignment is necessary, it is achieved by rotating the feed body 32 and the waveguide housing 12 so that the angular position of the arm portions 34 changes with respect to the longitudinal axis 16.

Figure 3:
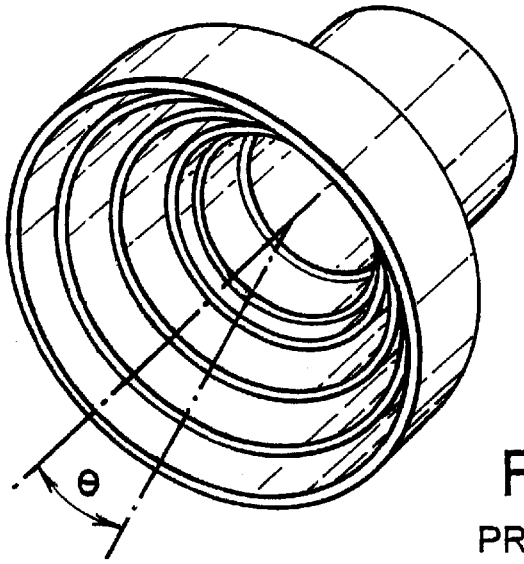
Fig. 3 PRIOR ART
FIG. 3 is a pictorial view of a prior art horn antenna feed.
Figure 4:
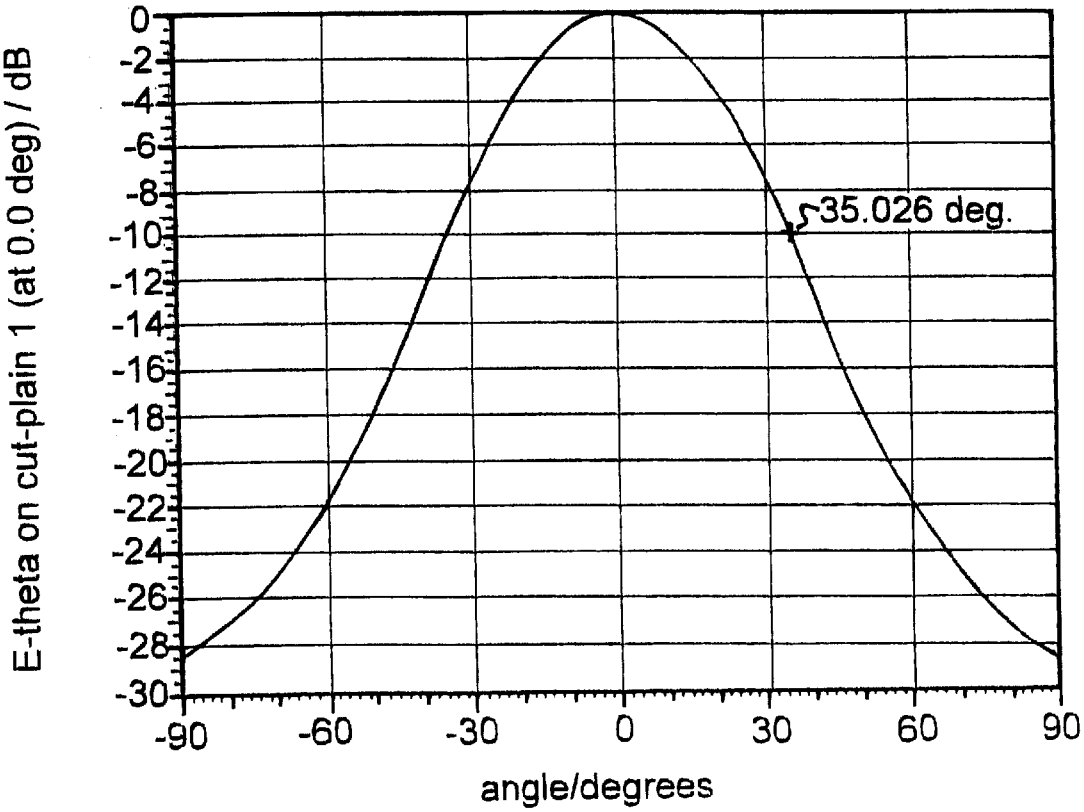
Fig. 4 PRIOR ART
FIG. 4 is a graph of the radiation pattern from the prior art horn feed of FIG. 3.
Figure 8:
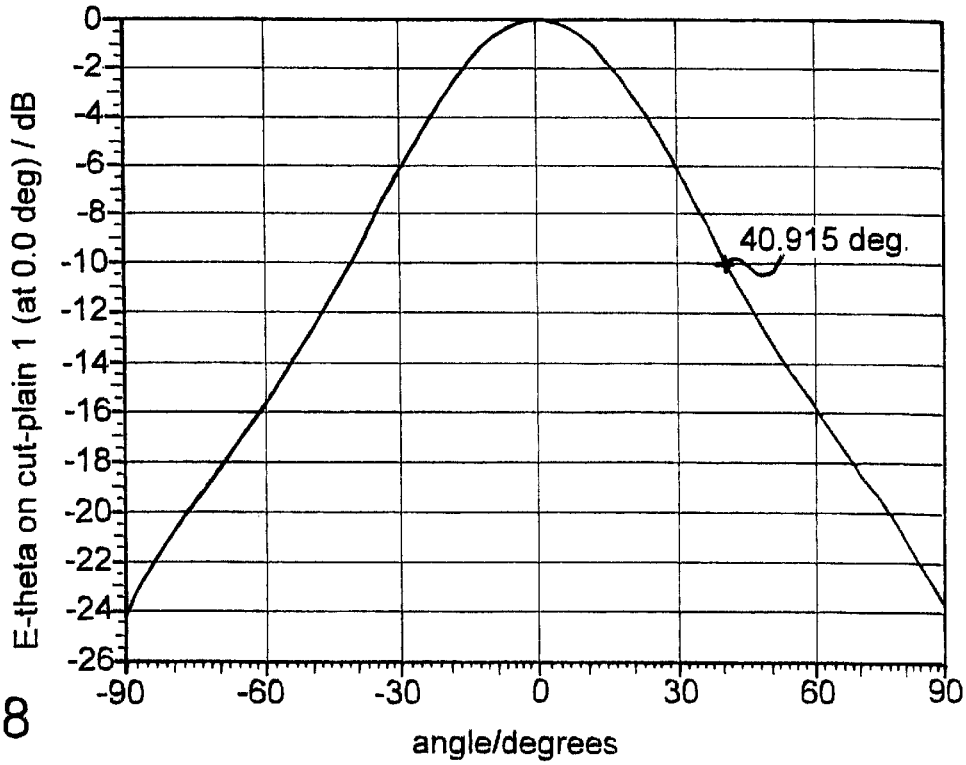
FIG. 8 is a graph of the radiation pattern from the antenna feed of FIG. 7.

FIG. 8 is a graph of the radiation pattern from the antenna feed of FIG. 7 when the arm portions 34 are aligned with the orthogonal linearly polarised signals conveyed from the antenna. It will be apparent that the radiation pattern from antenna feed 30 is similar to the radiation pattern from the prior art antenna feed shown. in FIG. 3. The shape of the two radiation patterns is similar: the main difference between the two patterns is that the prior art feed has a 10 dB half beamwidth of 35.0° at 11.7 GHz; whereas, feed 30 has a 10 dB half beamwidth of 40.9° at 11.7 Ghz.

Figure 9:
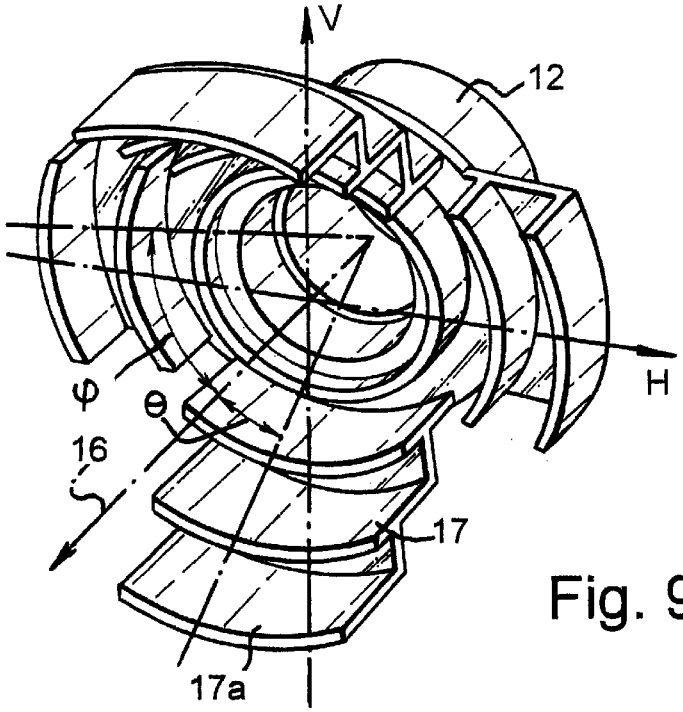
FIG. 9 is a diagram similar to FIG. 7 of a cross-type antenna feed for use with an elliptical antenna.
Figure 10:
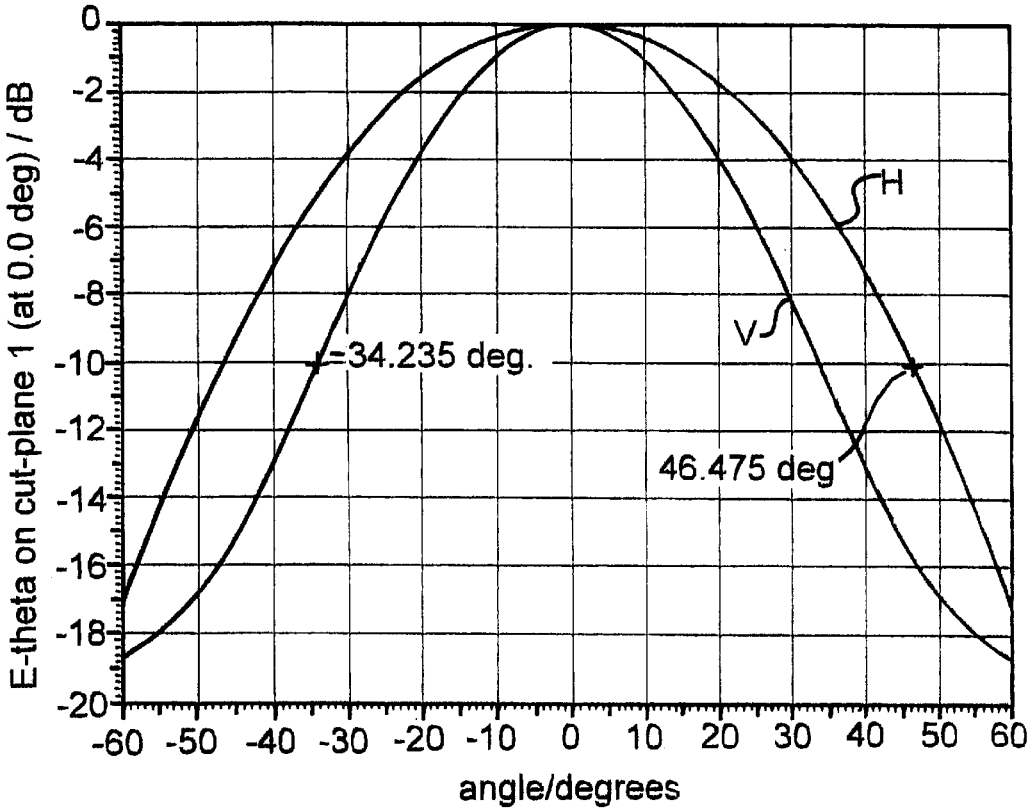
FIG. 10 is a graph of the radiation pattern for the cross-type antenna feed shown in FIG. 9.

FIG. 9 is a view similar to FIG. 7 but of a cross-type feed for receiving an elliptical beamshape for use with an elliptical dish. This is achieved by having different feed angles, θ and ϕ, in the horizontal and vertical planes as shown in FIG. 9. The respective feed angle θ, ϕ is the angle between the central axis 16 of the waveguide housing 12 and a plane defining the surface connecting the ridges of edges 17*a* of each of the arm portions 34. The positions and dimensions of the ridges 17 are chosen so as to a) give the necessary feed angles θ and ϕ, and b) to preserve the dual polarity aspect of the feed. FIG. 10 shows the elliptical beamshaping radiation pattern with 10 dB half beamwidth of 34° in the vertical plane (V) and 46.5° in the horizontal plane (H) at 11.7 GHz, the planes V and H being shown in FIG. 9. The number of ridges can be reduced in one, or both, of the cross-sections to reduce the size of the feed. Again there is no requirement for the incoming polarisation to be aligned with the cross-parts of the feed. The ridges 17 may be parallel to the central axis 16 or may form part of an elliptical shape centred on the axis 16.

FIG. 11 is a schematic diagram of an antenna system 50 in accordance with another embodiment of the present invention. FIG. 11 shows a low noise block (LNB) receiver 52 located at the focal point of a parabolic reflector antenna 54 for receiving linearly polarised signals. The LNB 52 has a feed body 14 and a waveguide housing 12 coupled to the feed body 14. The waveguide housing 12 has two probes disposed therein for receiving the orthogonal components of the linearly polarised signals travelling in the waveguide housing 12. Waveguide housing 12 also has a circuit board 64 disposed therein, where the circuit board 64 is in electrical communication with the probes for receiving the signals picked up by the probes. The signals are conveyed from the LNB 52 by means of a coaxial coupling 68.

Prior to use, the fingers 20 of the feed body 14 may be aligned, as a matter of choice, with the orthogonal components of the linearly polarised signals, as described above with reference to FIGS. 5*a* and 5*b* although this is not truly necessary.

Figure 12:
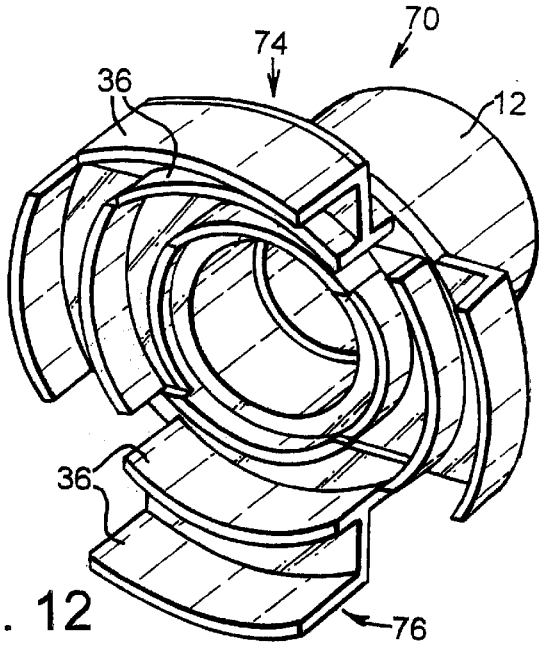
FIG. 12 is a diagram similar to FIG. 9 of a cross-type antenna feed for use with an elliptical antenna.
Figure 13:
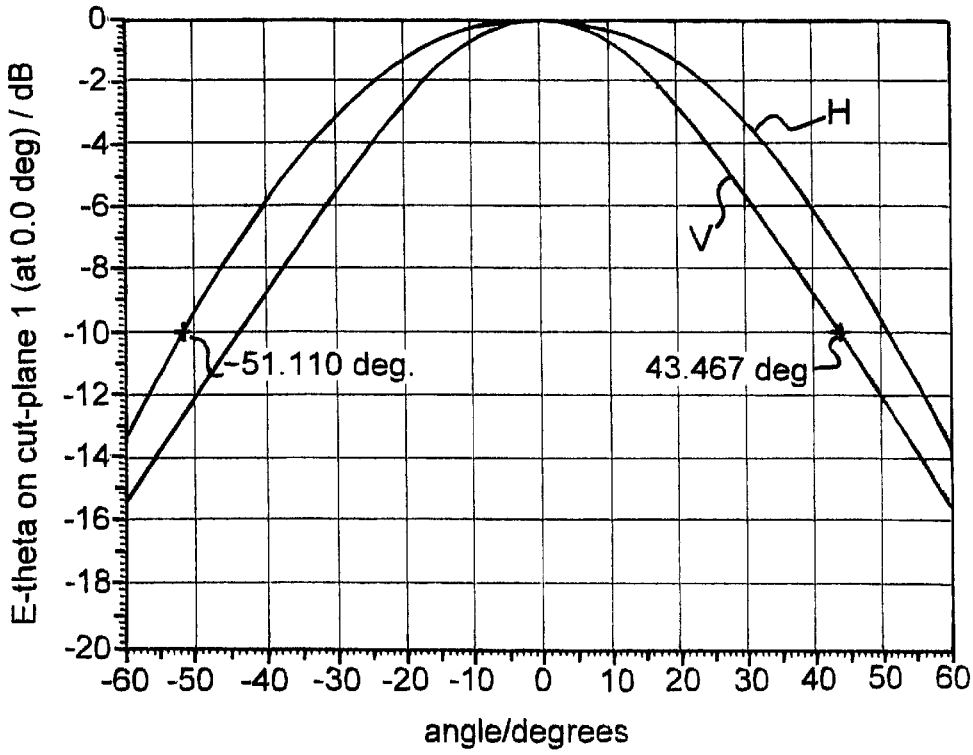
FIG. 13 is a graph of the radiation pattern for the cross-type antenna feed shown in FIG. 12.

FIG. 12 shows a cross-type feed indicated generally by reference numeral 70, similar to the cross-type feeds of FIG. 7, and particularly of FIG. 9, for receiving signals of an elliptical beamshape, where like parts share the same reference numerals. The feed 70 differs from the feed of FIG. 9 in that there are fewer ridges 36 in the arm portions 74 and 76 of the feed 70 than in the corresponding arm portions of the cross-type feed of FIG. 9. FIG. 13 shows the elliptical beamshaping radiation pattern for the feed 70, with a 10 dB half beamwidth of approximately 43.5° in the vertical plane (V) and approximately 51° in the horizontal plane (H) at 11.7 Ghz.

Figure 14:
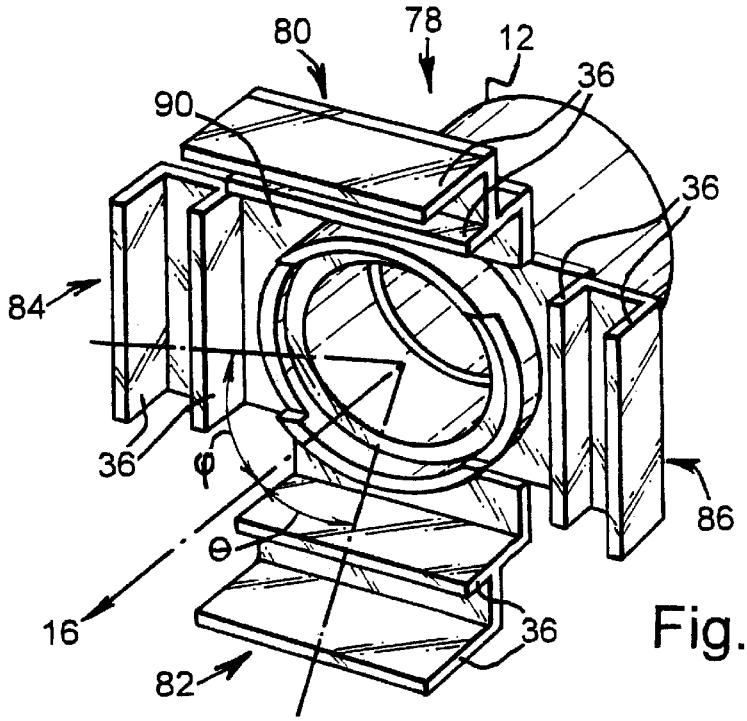
FIG. 14 is a diagram of a cross-type antenna feed in accordance with a further embodiment of the present invention.
Figure 15:
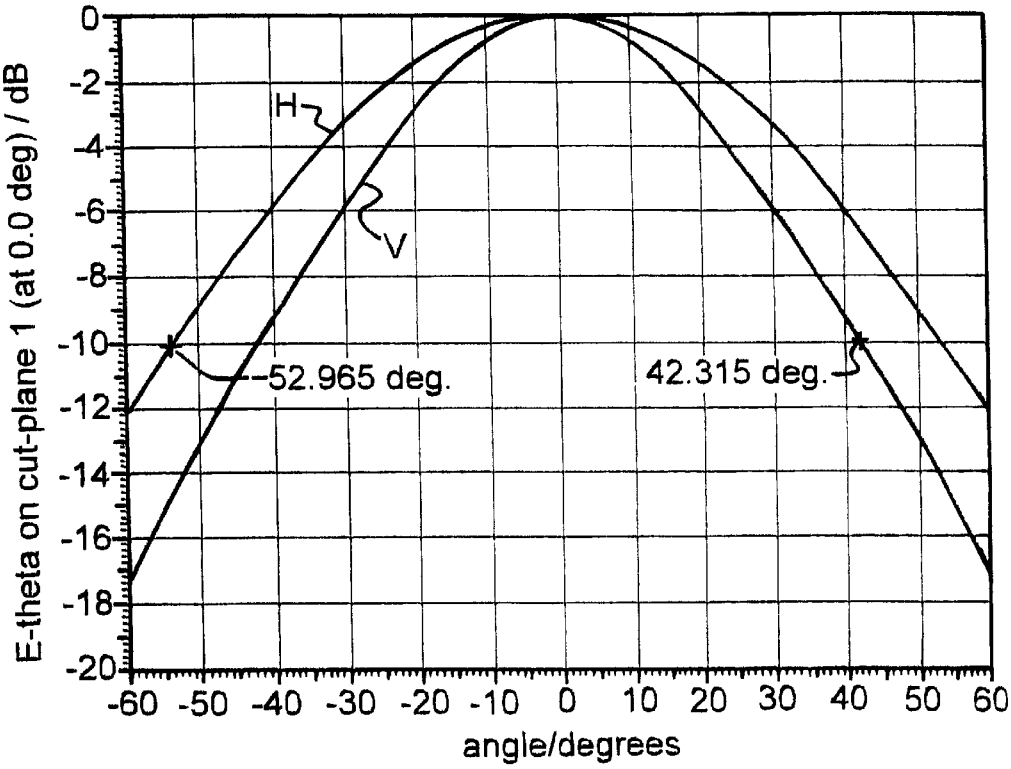
FIG. 15 is a graph of the radiation pattern for the cross-type antenna feed shown in FIG. 14.

FIG. 14 shows a cross-type feed indicated generally by reference numeral 78, in accordance with a further alternative embodiment of the present invention. The feed 78 includes corrugated arm portions 80, 82, 84 and 86, each of which includes ridges 36. Each of the ridges 36 are straight, generally rectangular plates which extend from a base portion 90 of the feed 78, which couples the arm portions 80, 82, 84 and 86 to a waveguide housing 12 of the feed 78. The ridges 36 on each arm portion 80, 82, 84 and 86 are disposed spaced radially from the central axis 16 of the feed 78 and substantially parallel to one another, and the arm portions 80, 82, 84 and 86 are spaced perpendicularly around the waveguide housing 12. Also, the ridges 36 on the arm portions 80 and 82 are disposed at a first feed angle θ from the central axis 16, whilst the ridges 36 on the arm portions 84 and 86 are disposed at a second feed angle ϕ. As will be appreciated by persons skilled in the art, this allows the feed 78 to receive signals of an elliptical beamshape, allowing the feed 78 to be used with an elliptical dish. FIG. 15 shows the elliptical beamshape radiation pattern for the feed 78, with a half beamwidth of approximately 42.5° in the vertical plane (V) and approximately 53° in the horizontal plane (H) at 11.7 GHz.

Figure 16:
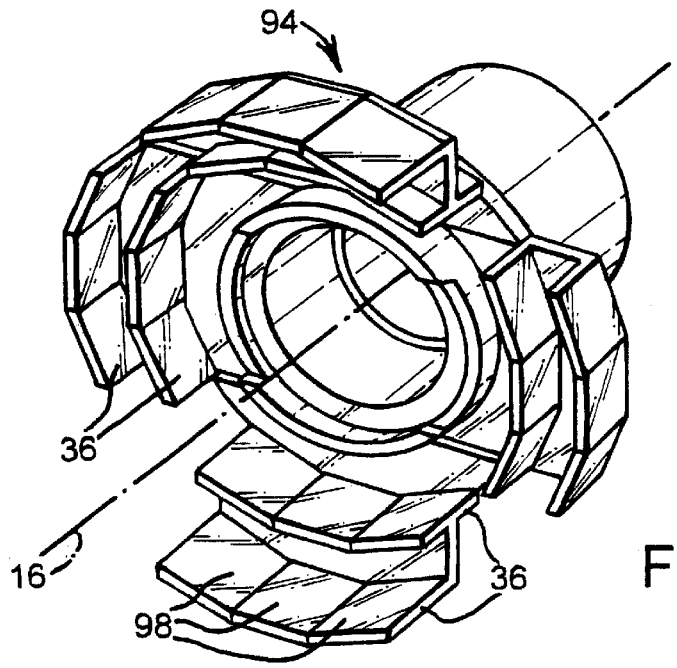
FIG. 16 is a diagram of a cross-type antenna feed in accordance with a yet further embodiment of the present invention.
Figure 17:
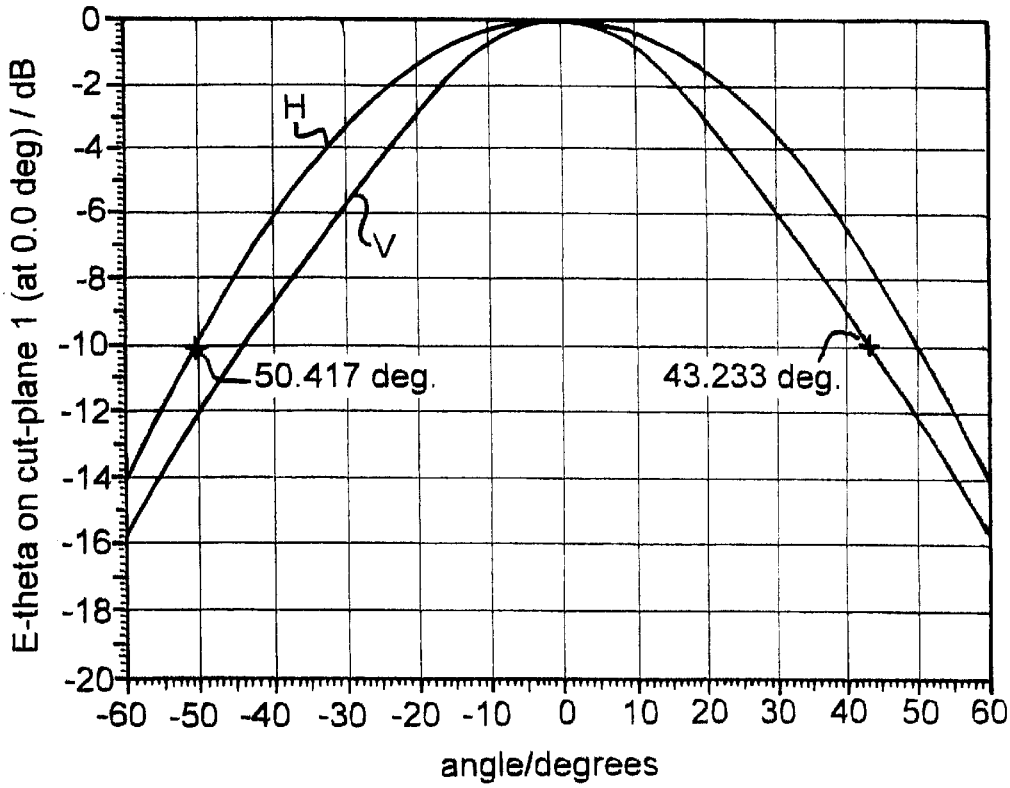
FIG. 17 is a graph of the radiation pattern for the cross-type antenna feed shown in FIG. 16.

FIG. 16 shows a cross-type feed indicated generally by reference numeral 94, in accordance with a yet further alternative embodiment of the present invention. The feed 94 is similar in structure to the feed 78 of FIG. 14, except that the feed 94 includes ridges 36, each of which comprise a series of straight plates 98 whose inner faces are disposed facing towards a central axis 16 of the feed 94. The places 98 are angled such that the ridges 36 generally follow the shape of an arc portion of a circle, when viewing the antenna feed 94 from the front, along the axis 16. FIG. 17 shows the elliptical beamshaping radiation pattern for the feed 94, with a half beamwidth of approximately 43° in the vertical plane (V) and approximately 50.5° in the horizontal plane (H) at 11.7 HGz.

Various modifications may be made to the above described embodiments. For example, the housing and the feed body may be manufactured as a single unit. Materials other than metal may be used for the housing. In other embodiments, the dielectric lens feed body may be made from materials other than polypropylene, such as other plastics, ceramic material, or wax.

Further modifications to the invention include casting the cross-type feed from a plastic material and then coating appropriate parts of the plastic material with a metallised layer to provide an electrical equivalent of the dielectric cross-feed to that shown in FIGS. 7 and 9. A further modification would be to use dielectric inserts in the corrugations to increase the dielectric properties of the cross-type feed which would minimise the size of the cross-type feed for receiving a particular frequency.

The dielectric lens feeds and cross-type feeds described above are also suitable for the reception of circularly polarised signals and with the addition of a circular to linear converter after the feed can be coupled to a conventional LNB. Circular to linear converters are well known in the field and can take various forms. In addition the embodiments described are particularly suitable for use with offset parabolic or prime focus parabolic antennas.

It will also be appreciated that the technique hereinbefore described could be applied to other waveguide flare cross-type feeds, for example conical cross-type feeds, such that material may be removed from the cross-type feed to leave a cruciform shape similar to that shown for the dielectric lens and corrugated cross-feed.

It will be appreciated that the embodiments of the invention hereinbefore described may be used with a wide range of frequencies including S-band, Ku-band and various other frequencies.

What is claimed is:

1. An antenna feed for use in a system for receiving orthogonal linear or circularly polarized signals, the antenna feed being a cross-type feed and comprising an antenna feed body for coupling to a waveguide housing, the feed body defining a central axis and having spaced arms extending radially outwardly from the central axis for receiving the polarized signals, the spaced arms being in the form of corrugated radially extending portions, each portion having ridges extending therefrom in spaced parallel relation.

2. An antenna feed for use in a system for receiving orthogonal linearly or circularly polarised signals, the antenna feed comprising an antenna feed body for coupling to a waveguide housing, the feed body defining a central axis and having a plurality of spaced arm portions extending radially outwardly from the central axis on a respective radius for receiving the polarised signals, each arm portion being corrugated and having at least one element arranged transversely to its respective radius.

3. The antenna feed as claimed in claim 2 wherein the antenna feed is a cross-type feed.

4. The antenna feed as claimed in claim 2 wherein the at least one element comprises a substantially straight ridge.

5. The antenna feed as claimed in claim 2 wherein the at least one element is disposed substantially perpendicularly to the respective arm portion radius.

6. The antenna feed as claimed in claim 2 wherein each arm portion has at least two elements arranged in spaced parallel relation.

7. The antenna feed as claimed in claim 2 wherein the at least one element comprises at least two straight ridges, disposed adjacent to and at an angle from one another.

8. The antenna feed as claimed in claim 7 wherein the at least one element comprises three straight ridges.

9. The antenna feed as claimed in claim 7 wherein each arm portion has at least two elements arranged in spaced parallel relation.

10. The antenna feed as claimed in claim 2 wherein the corrugated arm portions extend radially outwardly from the antenna feed body.

11. The antenna feed as claimed in claim 10 further comprising four corrugated arm portions disposed around a circumference of the antenna feed body.

12. The antenna feed as claimed in claim 11 wherein the four corrugated arm portions are mutually perpendicularly disposed around the circumference of the antenna feed body.

13. The antenna feed as claimed in claim 12 wherein first and second mutually opposed ones of said four corrugated arm portions are disposed at a first feed angle, whilst third and fourth mutually opposed ones of said four corrugated arm portions are disposed at a second feed angle.

* * * * *